US005909707A

United States Patent [19]

Gagne et al.

[11] Patent Number: 5,909,707

[45] Date of Patent: Jun. 8, 1999

[54] HIGH-SPEED PRINTING SYSTEM HAVING MULTIPLE SLIPPING NIPS

[75] Inventors: Daniel Paul Gagne, S. Berwick, Me.; Charles Douglas Lyman, Farmington, N.H.

[73] Assignee: Heidelberger Druckmaschinen AG, Heidelberg, Germany

[21] Appl. No.: 08/899,614

[22] Filed: Jul. 24, 1997

[51] Int. Cl.[6] ..... B41F 7/26; B41F 31/10; B41F 31/13

[52] U.S. Cl. ..... 101/148; 101/350.4; 101/483

[58] Field of Search ..... 101/349.1, 350.1, 101/350.2, 350.4, 363, 147, 148, 207–210, 483, 484; 118/258, 259

[56] References Cited

U.S. PATENT DOCUMENTS

| | | | |
|---|---|---|---|
| 3,433,155 | 3/1969 | Norton | 101/148 |
| 3,688,694 | 9/1972 | Preuss et al. | 101/148 |
| 3,937,141 | 2/1976 | Dahlgren | 101/148 |
| 3,986,452 | 10/1976 | Dahlgren | 101/148 |
| 4,046,931 | 9/1977 | Innes et al. | 101/363 X |

*Primary Examiner*—J. Reed Fisher
*Attorney, Agent, or Firm*—Kenyon & Kenyon

[57] ABSTRACT

A dampening system for an offset printing press system uses an intermediate roll between the press system and dampening rolls to create multiple slipping nips. By driving the intermediate roll at a surface velocity greater than the dampening roll speed and less than the press system speed, the speed ratio at each slipping nip may be reduced.

10 Claims, 4 Drawing Sheets

HIGH-SPEED PRINTING SYSTEM HAVING MULTIPLE SLIPPING NIPS

BACKGROUND INFORMATION

The present invention relates to dampening systems for offset presses, and more particularly relates to dampening systems in which the speed of the dampening system is different than the speed of the press system.

In prior offset presses, the rolls of the dampening system have operated at a velocity less than the rolls of the press system. This speed differential results in the formation of a slipping nip at the interface of the dampening system and the press system. A slipping nip, i.e. a nip at which the contacting surfaces of the opposed rollers slip against one another, is desirable in high-speed offset presses to achieve proper application of dampening fluid to the press rolls.

A prior art printing press system is shown, for example, by FIG. 1. A printing system 1 includes a dampening system 2 and a press system 3. The dampening system 2 includes a pan roll 5, which receives dampening fluid from a dampening fluid reservoir 4. A slip roll 6 is engaged with pan roll 5, and both pan roll 5 and slip roll 6 are driven to rotate at the same surface velocity (i.e. the linear speed at the surface of each roll is equal). The rotation and contact of the pan roll 5 and slip roll 6 thus cause the dampening fluid carried by pan roll 5 to be tranferred to slip roll 6.

Press system 3 includes a press roll 7, which is engaged typically via non-slipping nips with subsequent rolls in the press system (not shown). Press roll 7 also engages slip roll 6, and by such contact press roll 7 receives dampening fluid carried by slip roll 6. Press roll 7 will thereafter transfer the dampening fluid to the further elements of the press system. Press roll 7 is driven to rotate at a surface speed greater than surface speed of slip roll 6, thus causing a slipping nip 8 at the interface of the dampening system 2 and press system 3 to deliver dampening fluid to the press system 3.

It has been observed that fluid transfer across a slipping nip deteriorates when the speed ratio between the two engaged rolls (i.e. surface speed of fast roll: surface speed of slow roll) is large. In prior systems, in order to reduce the speed ratio at the slipping nip without reducing the press system speed, the speed of the dampening system was increased. However, this increase in the speed of the dampening system resulted in further problems. For example, at high dampening system speeds excessive amounts of fluid may be delivered to the press system. Furthermore, at high dampening system speeds dampening fluid may be thrown from the dampening system rolls, resulting in inconsistent delivery of dampening fluid.

SUMMARY OF THE INVENTION

The present invention is directed to a printing apparatus comprising a dampening system, including a pan roll and a slip roll, wherein the pan roll is in rolling contact with with the slip roll and the pan roll and slip roll rotate at a first surface velocity $V_1$; a press system including a press roll rotating at a second surface velocity $V_2$, wherein the second surface velocity $V_2$ is greater than the first surface velocity $V_1$; and a first intermediate roll disposed between the dampening system and the press system, the first intermediate roll in slipping contact with the slip roll and the press roll, wherein the intermediate roll rotates at a third surface velocity $V_3$ greater than the first surface velocity $V_1$ and less than the second surface velocity $V_2$.

The intermediate roll may be driven by drive mechanisms associated with the dampening system or with the press system, with the necessary adjustment in surface speed achieved by known gearing methods. The intermediate roll can also be driven independently of both the dampening system and the press system. Multiple intermediate rolls may also be used.

BRIEF DESCRIPTION OF THE DRAWINGS

FIG. 4(*b*) shows a second drive system of a printing system according to the present invention.

FIG. 4(*c*) shows a third drive system of a printing system according to the present invention.

DETAILED DESCRIPTION OF THE DRAWINGS

Figure 1:
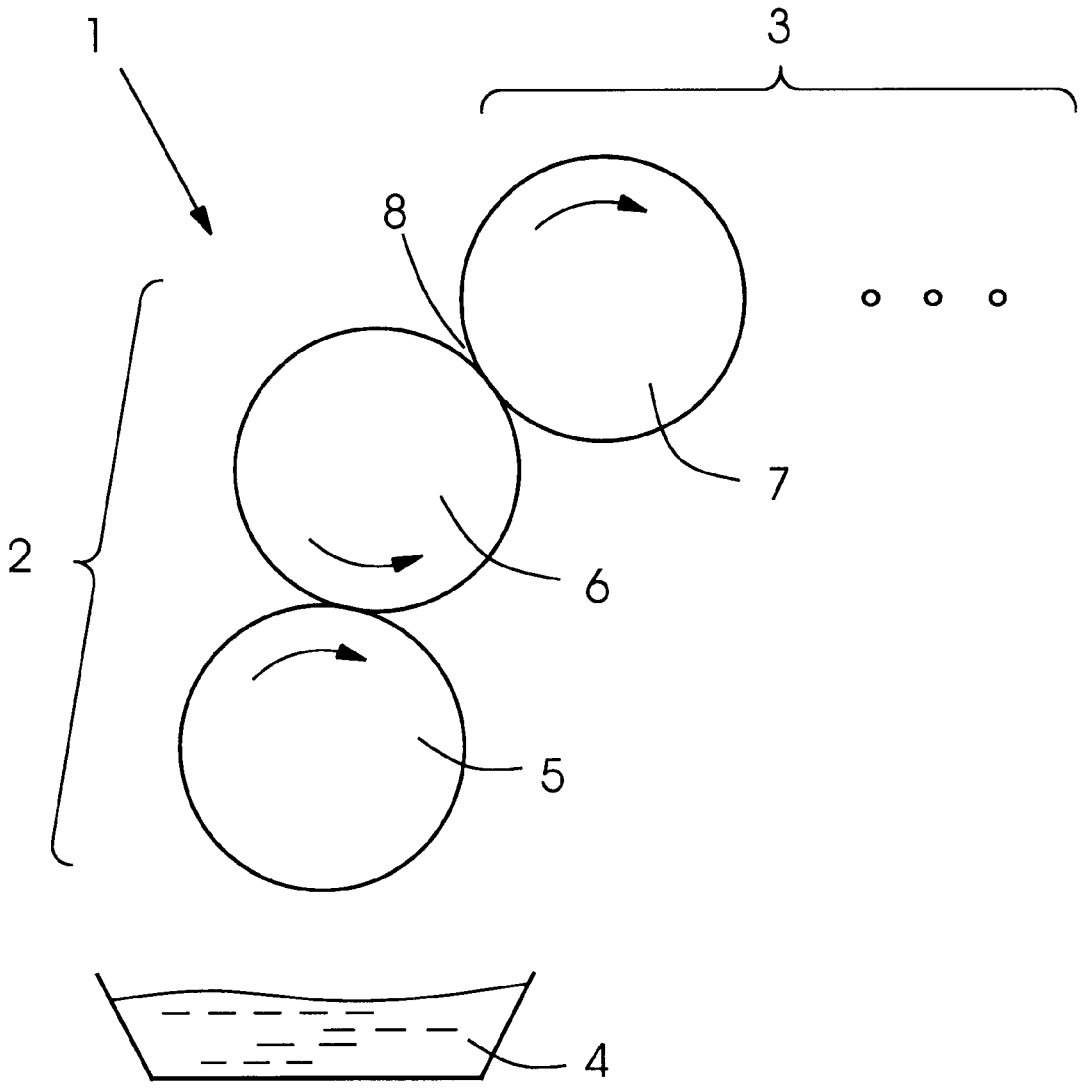
FIG. 1 shows a prior art printing system having a dampening system.
Figure 2:
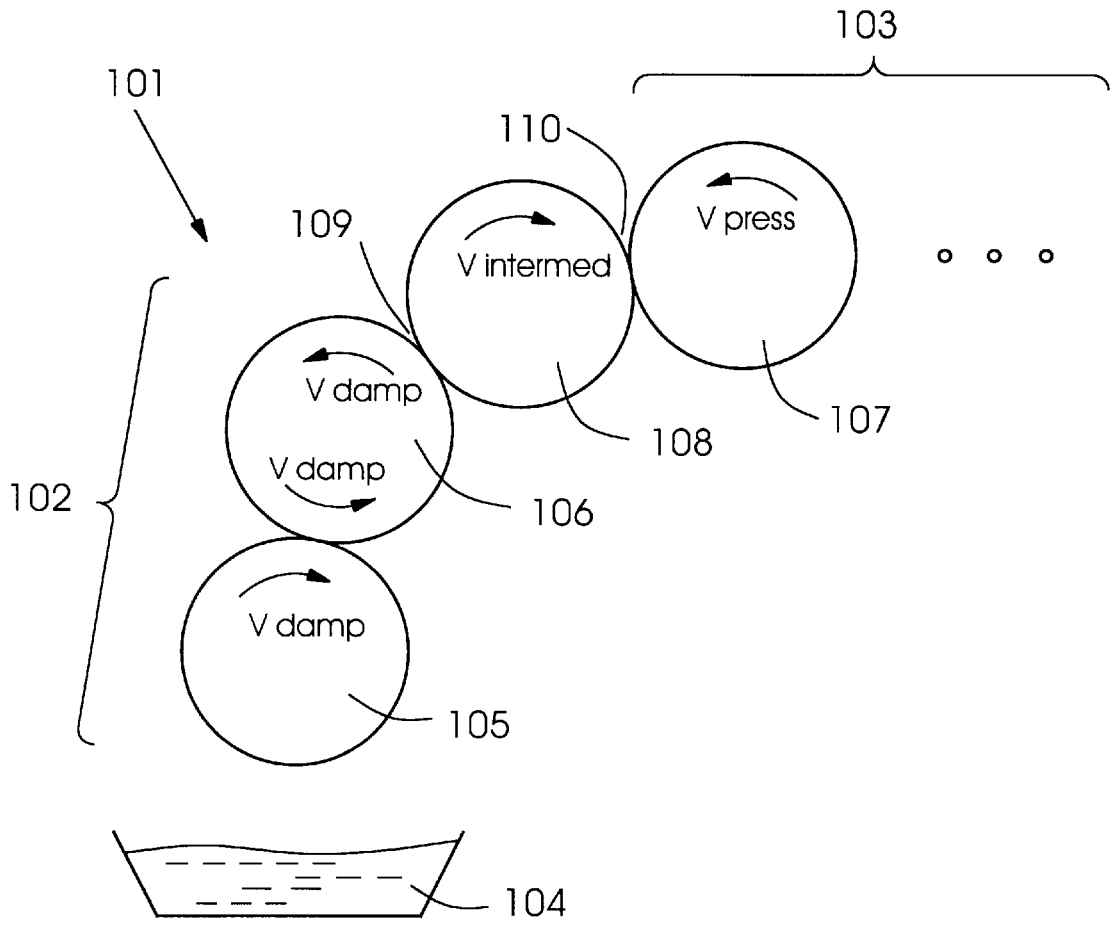
FIG. 2 shows a first embodiment of a printing system according to the present invention.

FIG. 2 shows a first embodiment of a printing system according to the present invention. Printing system 101 includes dampening system 102 and press system 103. Dampening system 102 includes at least one dampening roll, for example, a pan roll 105 that receives dampening fluid from a dampening fluid reservoir 104, for example, by being partially submerged in dampening fluid reservoir 104. Pan roll 105 is driven by a known driving device (not shown) to rotate at a surface speed $V_{damp}$ (the dampening system surface speed). The dampening system 102 also includes a slip roll 106, which contacts pan roll 105 at a nip 111. Slip roll 106 is also driven to rotate at the dampening system surface speed $V_{damp}$, for example, by the same driving devices used to drive pan roll 105.

Press system 103 uses a press roll 107 which engages further elements of press system 103 (not shown) to deliver dampening fluid received from the dampening system 102 to the press system 103. Press roll 107 is driven to rotate at a surface speed $V_{press}$ (the press system surface speed), which is greater than the dampening system surface speed $V_{damp}$.

An intermediate roll 108 is disposed between slip roll 106 and press roll 107. Intermediate roll 108 engages both slip roll 106 and press roll 107 to create a first slipping nip 109 at the point of contact of slip roll 106 and intermediate roll 108, and a second slipping nip 110 at the point of contact of intermediate roll 108 and press roll 107. Dampening fluid is transferred from slip roll 106 to intermediate roll 108 via first slipping nip 109, and is subsequently transferred from intermediate roll 108 to press roll 107 via second slipping nip 110.

Figure 4A:
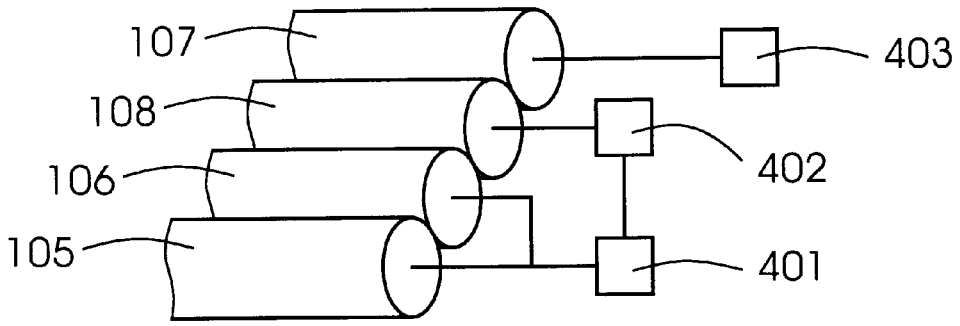
FIG. 4(*a*) shows a first drive system of a printing system according to the present invention.
Figure 4B:
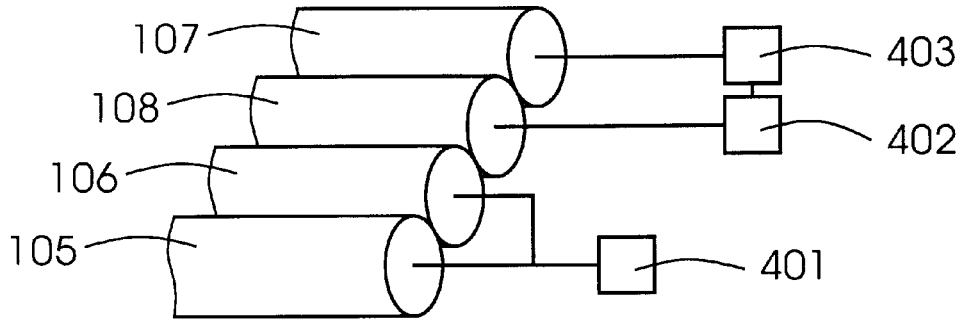
Figure 4C:
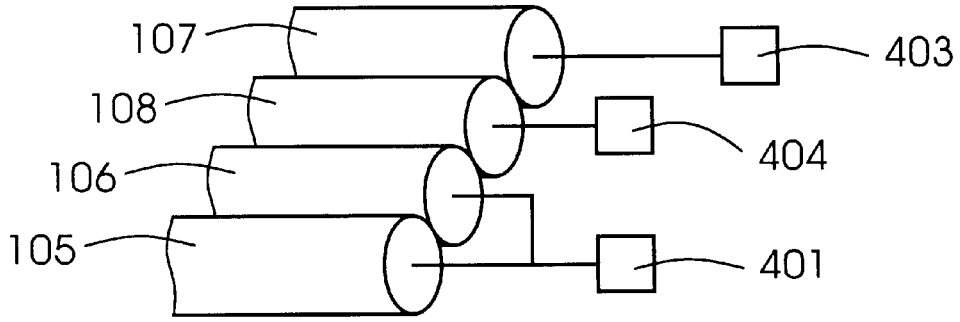

Intermediate roll 108 is driven to rotate at an intermediate surface speed $V_{intermed}$, which is greater than the dampening system surface speed $V_{damp}$ and less than the press system surface speed $V_{press}$. For example, as shown in FIG. 4(*a*), intermediate roll 108 may be driven by selecting a gearing ratio of a gearing mechanism 402 coupled between intermediate roll 108 and drive device 401 of the dampening system 102 such that a selected ratio of the surface speed of the slip roll 106 ($V_{damp}$) to the surface speed of the intermediate roll ($V_{intermed}$) is achieved. Alternately, as shown in FIG. 4(*b*), intermediate roll 108 may be coupled by gearing device 402 to drive device 403 of the press system 103, with a gearing ratio selected so that the surface speed of intermediate roll 108 ($V_{intermed}$) is a predetermined fraction of the press system surface speed $V_{press}$. Intermediate roll 108 may also be driven, as shown in FIG. 4(*c*), by independent drive means 404 which can be, for example, an independent motor, with a surface speed ($V_{intermed}$) independently controlled to achieve a desired speed relative to $V_{damp}$ and $V_{press}$.

By using both first slipping nip 109 and second slipping nip 110, the speed ratio at each slipping nip in the printing system 101 is reduced without increasing the speed of dampening system 102. To illustrate, since $V_{damp}<V_{intermed}<V_{press}$, $$V_{intermed}:V_{damp}<V_{press}:V_{damp}, \text{ and } V_{press}:V_{intermed}<V_{press}:V_{damp}.$$

Thus, the speed ratio at the first slipping nip ($V_{intermed}:V_{damp}$) and the speed ratio at the second slipping nip ($V_{press}:V_{intermed}$) will always be less than the speed ratio that would be present in a printing system comprising only a single slipping nip ($V_{press}:V_{damp}$).

Figure 3:
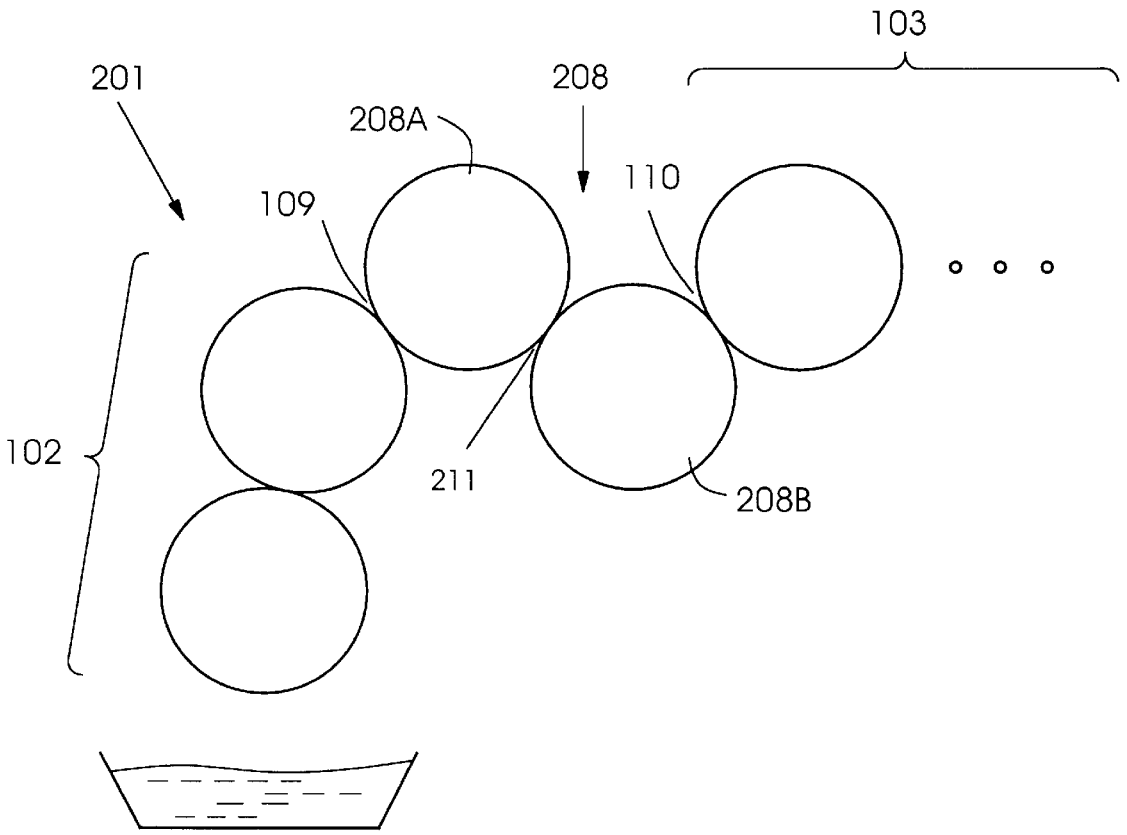
FIG. 3 shows a second embodiment of a printing system according to the present invention.

FIG. 3 shows another exemplary embodiment of a printing system according to the present invention. Printing system 201 also includes dampening system 102 and press system 103 as used in the first exemplary embodiment. However, as contrasted with the first exemplary embodiment, intermediate roll 108 (FIG. 2) is replaced by a plurality of intermediate rolls 208, for example, intermediate rolls 208A and 208B. Intermediate rolls 208A and 208B may be driven to rotate at equal surface speeds, resulting only in first slipping nip 109 and second slipping nip 110, as in the first exemplary embodiment. Intermediate rolls 208A and 208B may also be driven to rotate a different surface speeds, resulting in a third slipping nip 211. By so doing, additional speed ratio reduction for each slipping nip in the printing system may be achieved without increasing $V_{damp}$, according to the principles outlined above.

Those skilled in the art will recognize that the same gearing mechanisms or independent drive systems may be employed in any combination to ensure that the desired surface speeds of intermediate rolls 208A and 208B are achieved. Thus, when a third slipping nip 211 is formed, first intermediate roll 208A rotates with a first intermediate speed $V_{intermed1}$, while second intermediate roll 208B rotates at a second intermediate speed $V_{intermed2}$. The following relationship exists among the surface speeds:

$$V_{damp}<V_{intermed1}\leqq V_{intermed2}<V_{press}$$

Furthermore, those skilled in the art will recognize that any number of additional slipping nips may be employed to furthere reduce the speed differential at each slipping nip while maintaining or increasing the difference between the dampening system speed and the press system speed. This allows the press speed to be increased without necessitating a corresponding increase of the dampening system speed. Of course there are many other modifications to the disclosed embodiments which will be apparent to those skilled in the art and those modifications are considered to be within the teaching of this invention, which is to be limited only by the claims appended hereto.

What is claimed is:

1. An offset printing apparatus comprising:

a dampening system, including a pan roll and a slip roll, wherein the pan roll is in rolling contact with the slip roll;

a dampening system drive device, the dampening system drive device driving both the pan roll and the slip roll at the same surface velocity;

a press system including a press roll;

a press system drive device, the press system drive device driving the press roll at a surface velocity;

a first intermediate roll disposed between the dampening system and the press system, the first intermediate roll being in slipping contact with the slip roll and the press roll;

a gearing mechanism connected to the first intermediate roll, the gearing mechanism having a gear ratio, the gear ratio rotating the first intermediate roll at a surface velocity greater than the surface velocity of the pan roll and the slip roll and less than the surface velocity of the press roll.

2. The printing apparatus of claim 1, wherein the gearing mechanism is coupled between the first intermediate roll and the dampening system.

3. The printing apparatus of claim 1, wherein the gearing mechanism is coupled between the first intermediate roll and the press system.

4. The printing apparatus of claim 1, further comprising a second intermediate roll contacting the first intermediate roll and in slipping contact with the press roll.

5. An offset printing apparatus, comprising:

a dampening system, including a reservoir for dampening fluid, a pan roll which receives dampening fluid from the reservoir, and a slip roll in rolling contact with the pan roll, so that dampening fluid received by the pan roll from the reservoir is transferred to the slip roll;

a dampening system drive device, the dampening system drive device driving both the pan roll and the slip roll at the same surface velocity;

a press roll which receives dampening fluid from the dampening system;

a press system drive device, the press system drive device driving the press roll at a surface velocity;

an intermediate roll, coupled to the press roll and the slip roll so that dampening fluid from the slip roll is delivered to the press roll via the intermediate roll, wherein a first slipping nip exists between the slip roll and the intermediate roll, and a second slipping nip exists between the intermediate roll and the press roll; and a gearing mechanism connected to the intermediate roll; the gearing mechanism having a gear ratio, the gear ratio rotating the intermediate roll at a surface velocity greater than the surface velocity of the pan roll and the slip roll and less than the surface velocity of the press roll.

6. A offset printing method comprising:

providing a dampening system, including a pan roll and a slip roll;

placing the pan roll in rolling contact with the slip roll;

rotating the pan roll and slip roll at a first surface velocity $V_1$;

providing a press system including a press roll;

rotating the press roll at a second surface velocity $V_2$, wherein the second surface velocity $V_2$ is greater than the first surface velocity $V_1$;

providing a first intermediate roll disposed between the dampening system and the press system;

coupling a gearing mechanism to the first intermediate roll;

placing the first intermediate roll in slipping contact with the slip roll and the press roll; and rotating the first intermediate roll using the gearing mechanism at a third surface velocity $V_3$ greater than the first surface velocity $V_1$ and less than the second surface velocity $V_2$.

7. The printing method of claim 6, further comprising:

coupling the gearing mechanism between the first intermediate roll and the dampening system.

8. The printing method of claim 6, further comprising:

coupling the gearing mechanism between the first intermediate roll and the press system.

9. The printing method of claim 6, further comprising:

providing a second intermediate roll; and placing the second intermediate roll in contact with the first intermediate roll and in slipping contact with the press roll.

10. An offset printing method, comprising:

providing a dampening system, including a reservoir for dampening fluid, a pan roll which receives dampening fluid from the reservoir, and a slip roll in rolling contact with the pan roll;

transferring dampening fluid received by the pan roll from the reservoir to the slip roll;

rotating the pan roll and slip roll at a first surface velocity $V_1$;

providing a press roll which receives dampening fluid from the dampening system;

rotating the press roll at a second surface velocity $V_2$;

coupling an intermediate roll to the press roll and the slip roll;

coupling a gearing mechanism to the intermediate roll;

delivering dampening fluid from the slip roll to the press roll via the intermediate roll;

rotating the intermediate roll using the gearing mechanism at a third surface velocity $V_3$ greater than the first surface velocity $V_1$ and less than the second surface velocity $V_2$;

providing a first slipping nip between the slip roll and the intermediate roll; and providing a second slipping nip between the intermediate roll and the press roll.

* * * * *